United States Patent [19]

Jones

[11] Patent Number: 5,001,839

[45] Date of Patent: Mar. 26, 1991

[54] BUILDING PROFILING TOOLS

[76] Inventor: David J. Jones, 27, Pant-y-Fid Road, Aberbargoed, Mid Glam., United Kingdom

[21] Appl. No.: 358,333

[22] Filed: May 2, 1989

[30] Foreign Application Priority Data

Nov. 3, 1986 [GB] United Kingdom ..... 8626244

[51] Int. Cl.[5] ..... G01C 15/10

[52] U.S. Cl. ..... 33/404; 33/408

[58] Field of Search ..... 33/404, 405, 406, 407, 33/408

[56] References Cited

U.S. PATENT DOCUMENTS

| | | | |
|---|---|---|---|
| 2,143,237 | 1/1939 | Byrnes | 33/409 |
| 2,656,608 | 10/1953 | Craig et al. | 33/410 X |
| 2,811,778 | 11/1957 | Snyder | 33/407 |
| 4,689,889 | 9/1987 | Reeves | 33/408 |

FOREIGN PATENT DOCUMENTS

| | | | |
|---|---|---|---|
| 819913 | 11/1951 | Fed. Rep. of Germany | 33/404 |
| 2503353 | 10/1982 | France | 33/404 |
| 2134580 | 8/1984 | United Kingdom . | |

*Primary Examiner*—Harry N. Haroian

*Attorney, Agent, or Firm*—Body, Vickers & Daniels

[57] ABSTRACT

A profiling tool, which is suitable for providing a reference for an internal or external brickwork corner at a right angle or a predetermined non-perpendicular angle, comprises a plate to be secured typically to a horizontal course of brickwork and a datum post arranged for locating a higher course of brickwork. The post is pivotally connected to the plate and is arranged to be set at an angle to the horizontal. The plate is fixed in place by means of anchors embedded in only a single course of bricks.

28 Claims, 11 Drawing Sheets

BUILDING PROFILING TOOLS

The present invention is concerned with building profiling tools, for use by bricklayers. (In the present specification, the terms "bricks", "brickwork" and the like are to be construed so as to cover any type of block structure used in building work, such as standard house bricks, breeze blocks, concrete or stone blocks.)

When building brickwork, it is generally important that the bricks are true vertically and that the bricks lie horizontal in their courses. Traditionally, this has been achieved by a skilled bricklayer building corners first, with runs between the corners being laid in backward and forward runs between the initially built corners; these runs can be constructed by a relatively inexperienced bricklayer.

Devices have been proposed which can provide a reference for a brickwork corner in order to speed up the construction of the corners; examples of such devices (which are known as profiling tools) are disclosed in U.K. Patent Specification Nos. 2120718, 2142966 and 2158863 and European Patent Specification No. 44896.

Some recent profiling tools can be used for both internal and external corners, but known profiling tools are designed specifically for right-angled corners.

I have now developed a profiling tool which is suitable for non-perpendicular angles, in addition to right-angles, and which can be used for both internal and external angles.

According to the invention, therefore, there is provided a building profiling tool, which comprises:

at least one plate capable of being secured to at least one course of brickwork with a predetermined orientation to the horizontal (which orientation is typically substantially horizontal);

means for securing the or each plate to a respective course of brickwork;

a datum post provided with means for locating a further course of brickwork to be laid over said first-mentioned course of brickwork;

means for providing a pivotal connection between said datum post and one said plate; and means for setting said datum post at an angle to the horizontal such that when said further course of brickwork is laid to said locating means, said further course of brickwork is at a preset angle to the predetermined orientation.

The preset angle may be either substantially perpendicular, or inclined, for example, at an acute angle, in the range of 60 to 90 degrees. In the case where the preset angle is perpendicular, the means for setting the datum post at an angle to the horizontal may be a plumb-bob line associated with an appropriate centering indicator and/or at least one bracing element as described hereinafter. In the case where the predetermined angle is acute, the means for setting the angle may be a scale provided on the pivotal connection, a connecting element between predetermined locations on the brickwork securing plate and the datum post, or separate gauging means.

The means for setting the datum post at an angle to the horizontal may comprise, for example, at least one bracing element arranged to secure the datum post to a base anchor (which may be provided on a course of brickwork or on a separate anchoring element). The bracing element is such that it engages the datum post and with the base anchor at a predetermined position such that the datum post is constrained at the required angle. The bracing element is preferably arranged to connect the datum post to the course of brickwork to which the plate is secured. Such a bracing element (which is typically in the form of an elongate strut) is preferably secured to both the plate and the datum post by for example a pivotal connection. The bracing element is preferably arranged to be secured at one end to the datum post in a range of longitudinally spaced positions.

The datum post may be provided with a calibrated series of gauge marks so that the height of the course of brickwork being laid can be checked; a horizontal line holder may be slidably mounted on or within the datum post. It is particularly advantageous for the line holder to be mounted within the datum post.

It is preferred that the datum post be provided with sighting means (which may be detachable), so that the datum post can be aligned with a fixed point or with another profiling tool according to the invention. In this way, the profiling tool according to the invention can be used to ensure that a wall is constructed in correct alignment.

The datum post is preferably detachable from the plate; the datum post, with calibrated gauge marks and, preferably, sighting means, can be used for other civil engineering purposes, such as, for example, in pipelaying work.

The profiling tool according to the invention may be provided with a pair of mutually perpendicular brickwork locating plates. It is, however, particularly preferred that the datum post should be detachably and pivotally connected to a plate which is to be secured to a single, substantially planar face of brickwork.

The plate itself may be such that it can be secured flush to the brickwork (that is, generally substantially vertical) or substantially perpendicular to the brickwork.

The plate may be secured to the brickwork by any suitable means, such as, for example, bolts secured in the brickwork or in the mortar between bricks.

The means for locating brickwork provided on the datum post is typically a slide member capable of sliding along the datum post; the slide member preferably has an end surface for locating courses of brickwork higher than the one to which the plate is secured.

As previously mentioned, the datum post is connected to the plate by a pivotal connection, which is preferably detachable. In one embodiment of the invention, the pivotal connection is provided by an elongate projection on either the end of the datum post or on a pivot joint member disposed on the plate, and a corresponding complementary recess on, respectively, the pivot joint member or the datum post. In this embodiment, the elongate projection is preferably pivotally mounted on a pivot joint member (such as a ball joint) disposed on the plate to be secured to the course of brickwork; in this case, the pivotal connection may be in the nature of a universal joint.

In a further embodiment of the invention, the pivotal connection comprises a cylindrical or part-cylindrical aperture provided on said datum post, and a cylindrical member which is engageable with the plate and arranged to fit snugly within the aperture.

It is in any case preferred that the pivotal connection is such that the datum post may rotate through 360° about at least one axis. Preferably, the pivotal connection is such that the datum post may pivot about two mutually perpendicular axes.

Preferred embodiments of profiling tools according to the invention, and the use thereof, will now be described, by way of example, with reference to FIGS. 1 to 15 of the accompanying drawings, in which.

Figures 1, 1A, 2:
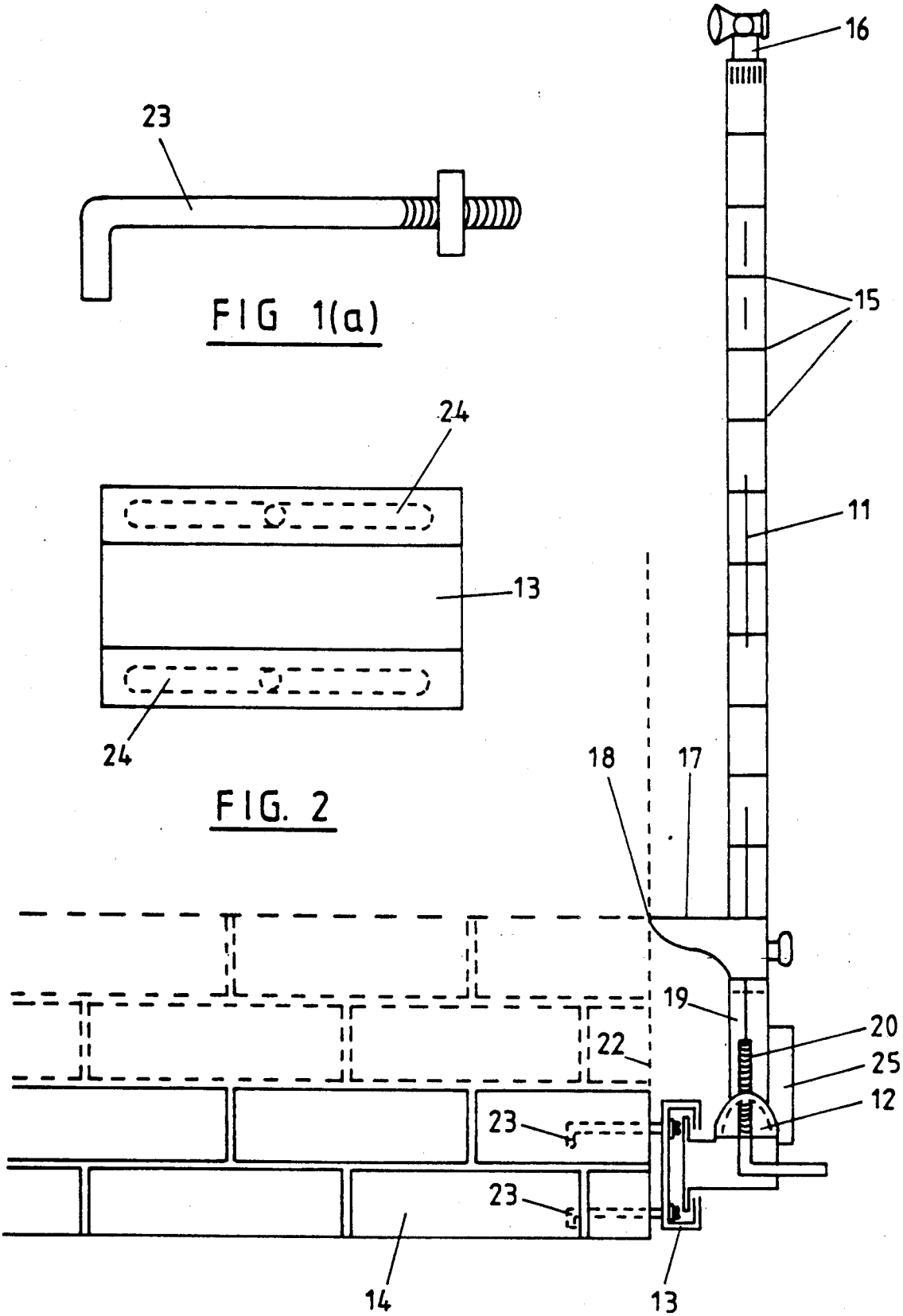
FIG. 1 is a schematic view of a first embodiment of profiling tool according to the invention.
FIG. 2 shows in more detail a fixing plate used in the profiling tool of FIG. 1 (this fixing plate being similar to that illustrated in U.K. Specification No. 2158863)

Referring to FIG. 1, there is shown a profiling tool comprising a datum post 11 pivotally connected by ball joint 12 to a plate 13 which is secured to the vertical face of a horizontal course of brickwork 14.

Datum post 11 has a series of calibrated gauge marks 15; detachably secured to the top of the datum post 11 is a sighting scope 16, which is height adjustable on the datum post. Within the datum post may be disposed a plumbob line, which may be viewed through one or more viewing ports such that the datum post can be set vertically.

Slidably mounted on the datum post 11 is a brickwork locating slide 17 having a protruding tongue 18 arranged to engage the surface of the brickwork. The tongue 18 may also function as a horizontal line support.

Towards the foot of datum post 11 is an elongate recess 19 in which is located a shaft 20 pivotally mounted on ball joint 12, which is itself slidably mounted on fixing plate 13 (shown in more detail in elevation in FIG. 2). The fixing plate 13 is secured to brickwork 22 by hooked bolts 23, which are shown in more detail in FIG. 1(*a*). Four such bolts 23 are preferably used for each plate, the bolts being located in slots 24 (FIG. 2) such that the plate can be slidably adjusted in position on the brickwork 22.

Ball joint 12 is provided with an angle marked scale (not shown) and a pointer 25.

Figure 3:
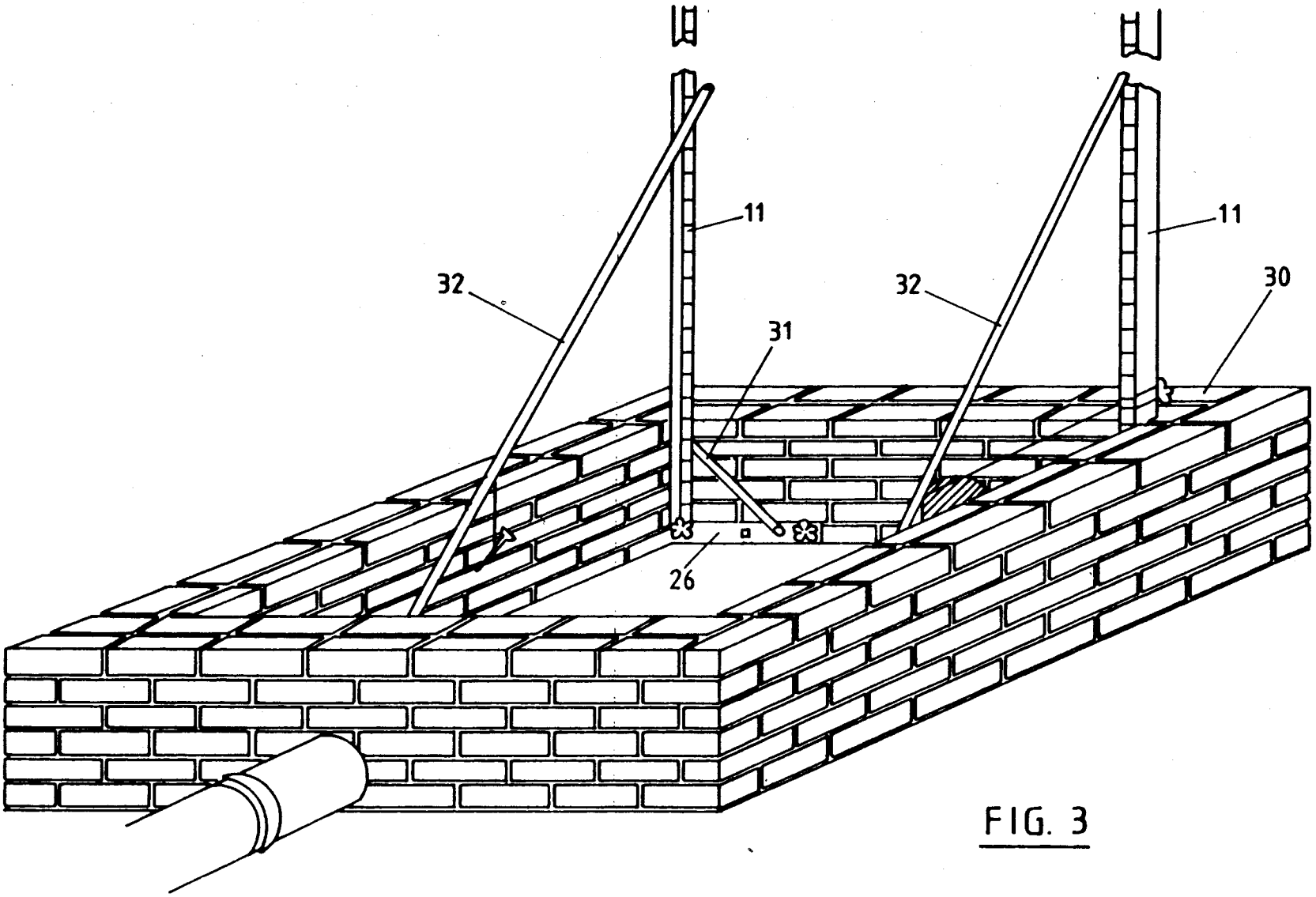
FIG. 3 shows the use of two exemplary profiling tools according to the invention for internal corners.

Referring now to FIG. 3 (in which parts corresponding to those shown in FIG. 1 are indicated by like reference numerals), two datum posts 11 are mounted on plates 26 which are mounted on the internal corners of a brickwork structure 30 (which may be a drainage chamber, an access chamber or a lift shaft). Each datum post 11 is connected to plate 26 by means of short bracing strut 31, and connected to the brickwork structure 30 by means of long bracing strut 32. The bracing struts 31 and 32 are preferably arranged to be secured at one end to the datum post in a series of longitudinally spaced positions; strut 31 may be pivotally connected to the datum post 11 and/or to the plate 26.

Figure 4:
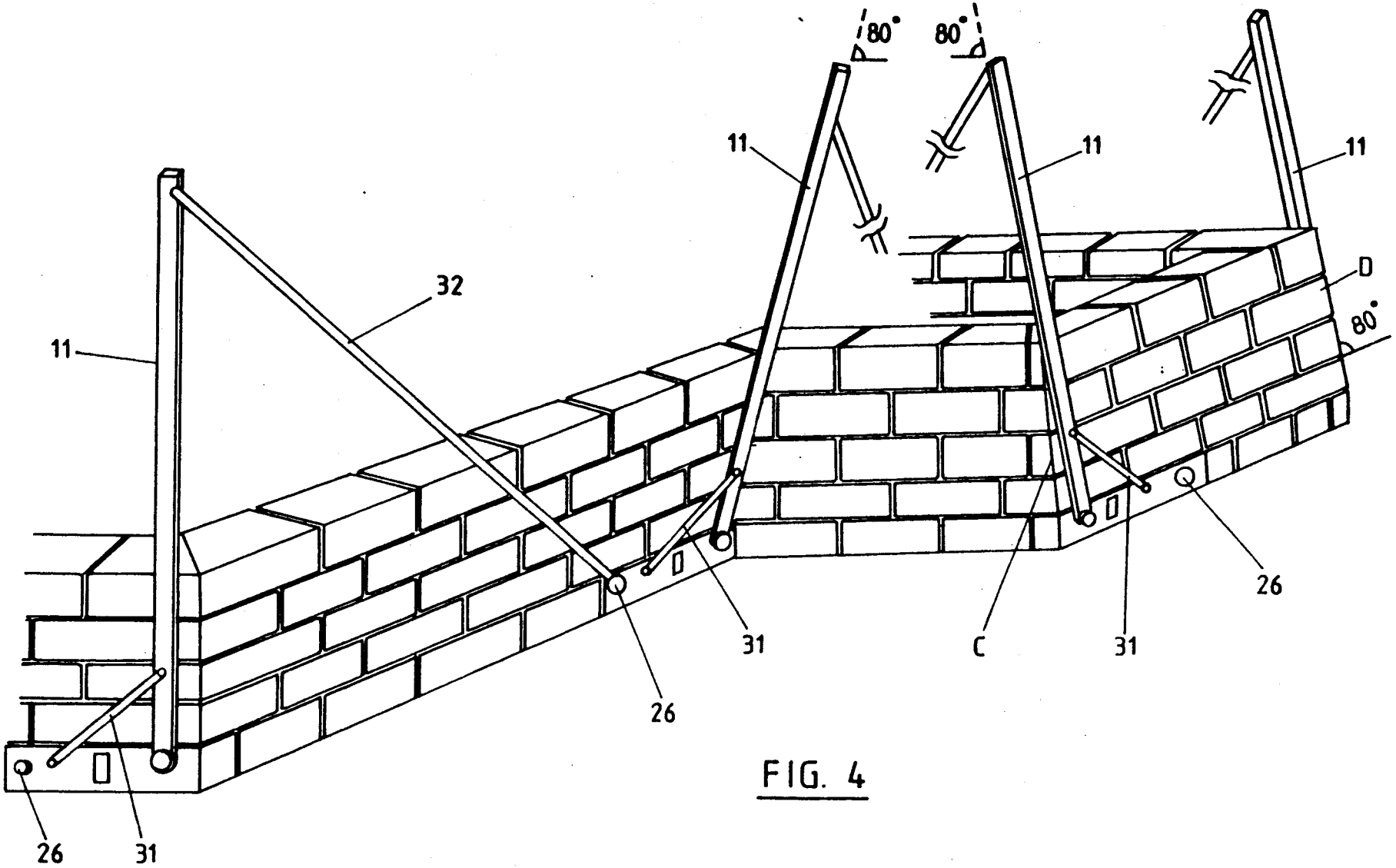
FIG. 4 shows the use of four profiling tools similar to the one shown in FIG. 3 for setting both external and internal corners and also non-vertical brickwork construction.

A broadly similar arrangement is illustrated in FIG. 4 (and like parts are again denoted by like reference numerals) except that external corners as well as internal corners are marked out, as well as non-vertical angles, such as about 80 degrees.

Figure 5:
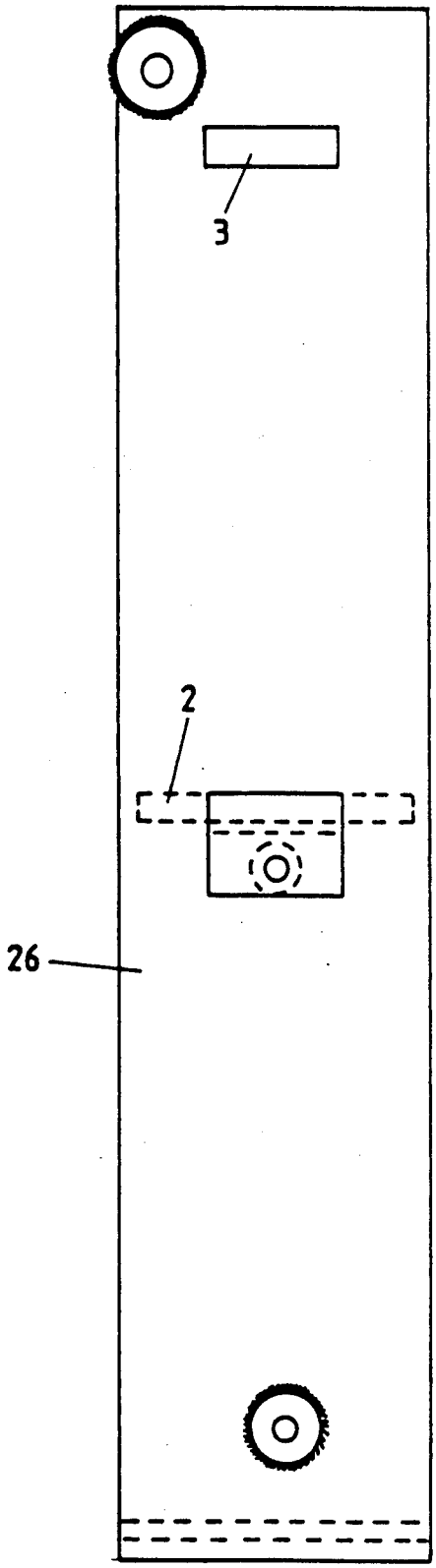
FIG. 5 shows in more detail the fixing plate used in the profiling tools illustrated in FIG. 3.
Figure 6:
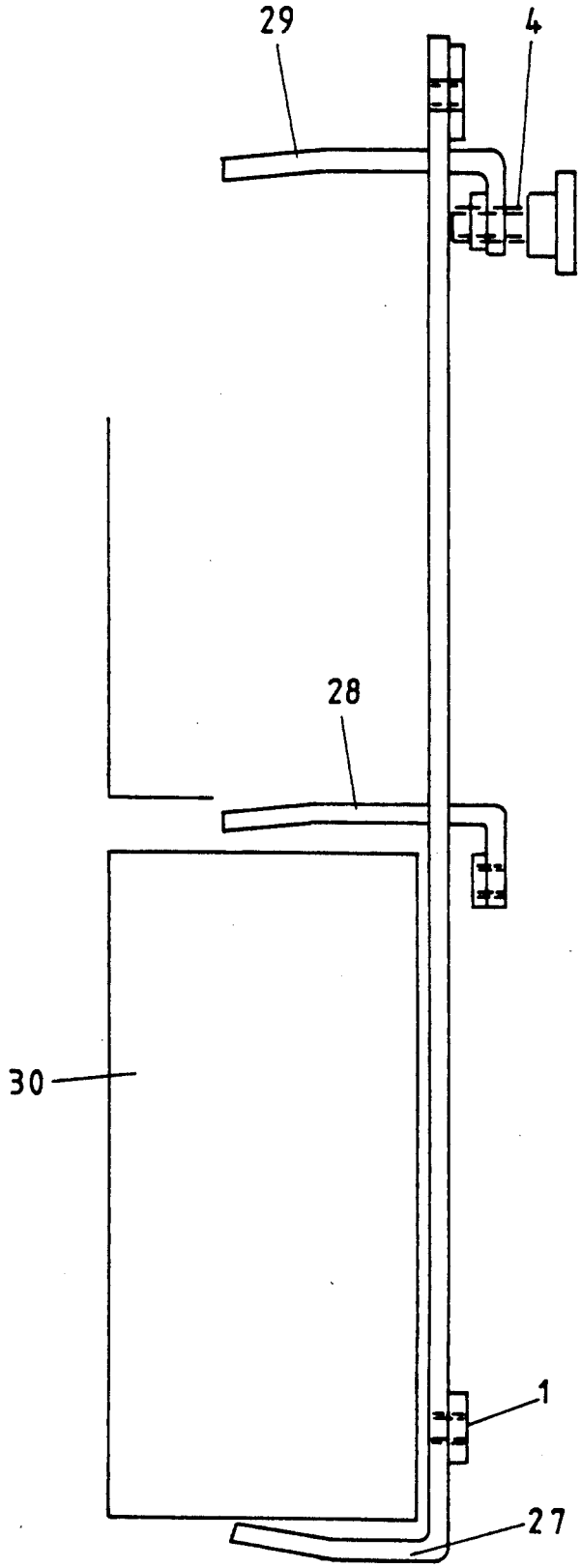
FIG. 6 shows the clamping devices used with the plate shown in FIG. 5.

Referring to FIGS. 5 and 6, the plate 26 by which each datum post 11 is secured to the brick structure 30 has three prongs 27,28,29 secured thereto. Prong 27 (which engages the edge of one brick) is secured to plate by screw 1, while prong 28 passes through an aperture 2 in the plate 26 to engage the other edge of the brick. Prong 29 itself passes through an aperture 3 in the plate 26 to engage the edge of the next adjacent brick. Prong 29 is secured to the plate 26 by a tightening screw 4; as the latter is tightened, the prong is caused to positively grip the edge of the brick. A plate having such a gripping action is believed to be novel per se.

Figure 7:
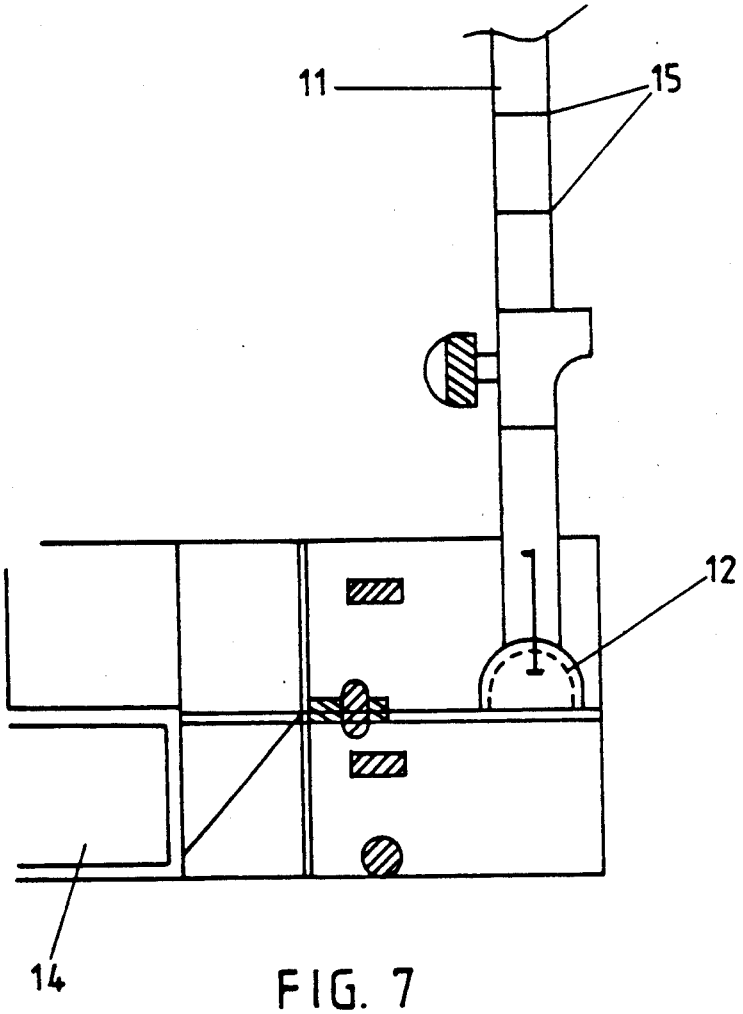
FIG. 7 is a schematic view of a further embodiment of profiling tool according to the invention.
Figure 8:
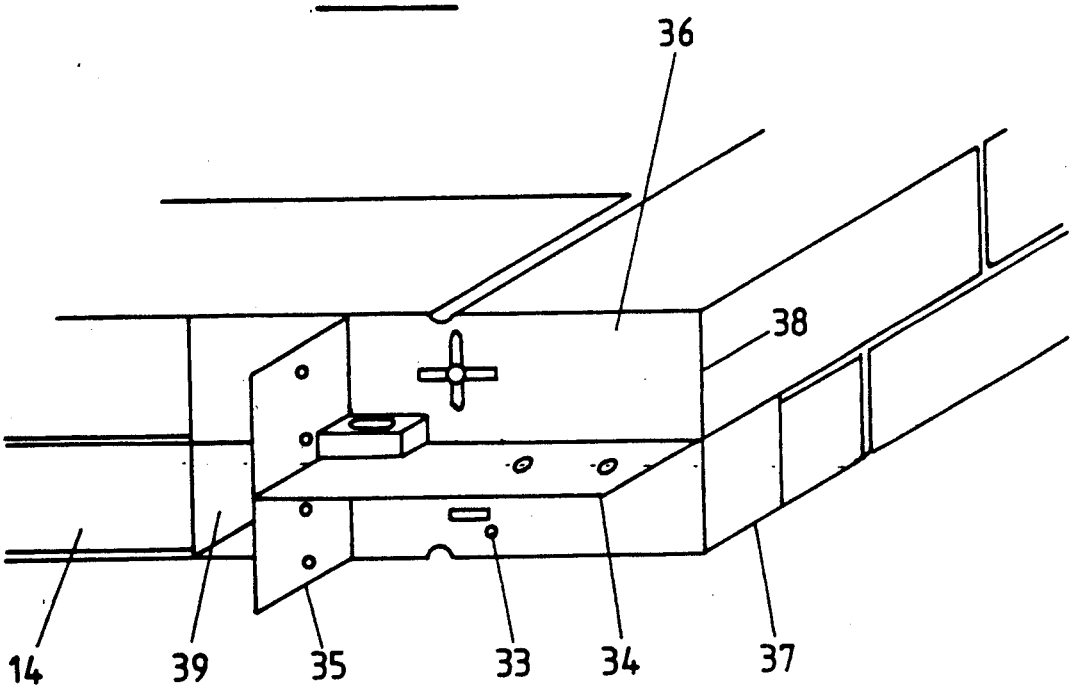
FIG. 8 shows in more detail the fixing plate used in the embodiment of FIG. 7.

Referring to FIGS. 7 and 8, the upper end of the profiling tool is essentially as shown in FIG. 1; the plate by which the ball joint 12 is secured to the brickwork is, however, modified.

The plate 33 comprises a horizontal sheet member 34 which is integral with reinforcing flanges 35,35'; the sheet member is secured to a plate 36 which is itself secured to brickwork 14. The end of the plate 36 has a lateral projection 37 which overlaps around an external angle 38 of the brickwork 14; the other end of the plate 36 has a projection 39 which is secured to the brickwork by a clamp (not shown).

Figure 9:
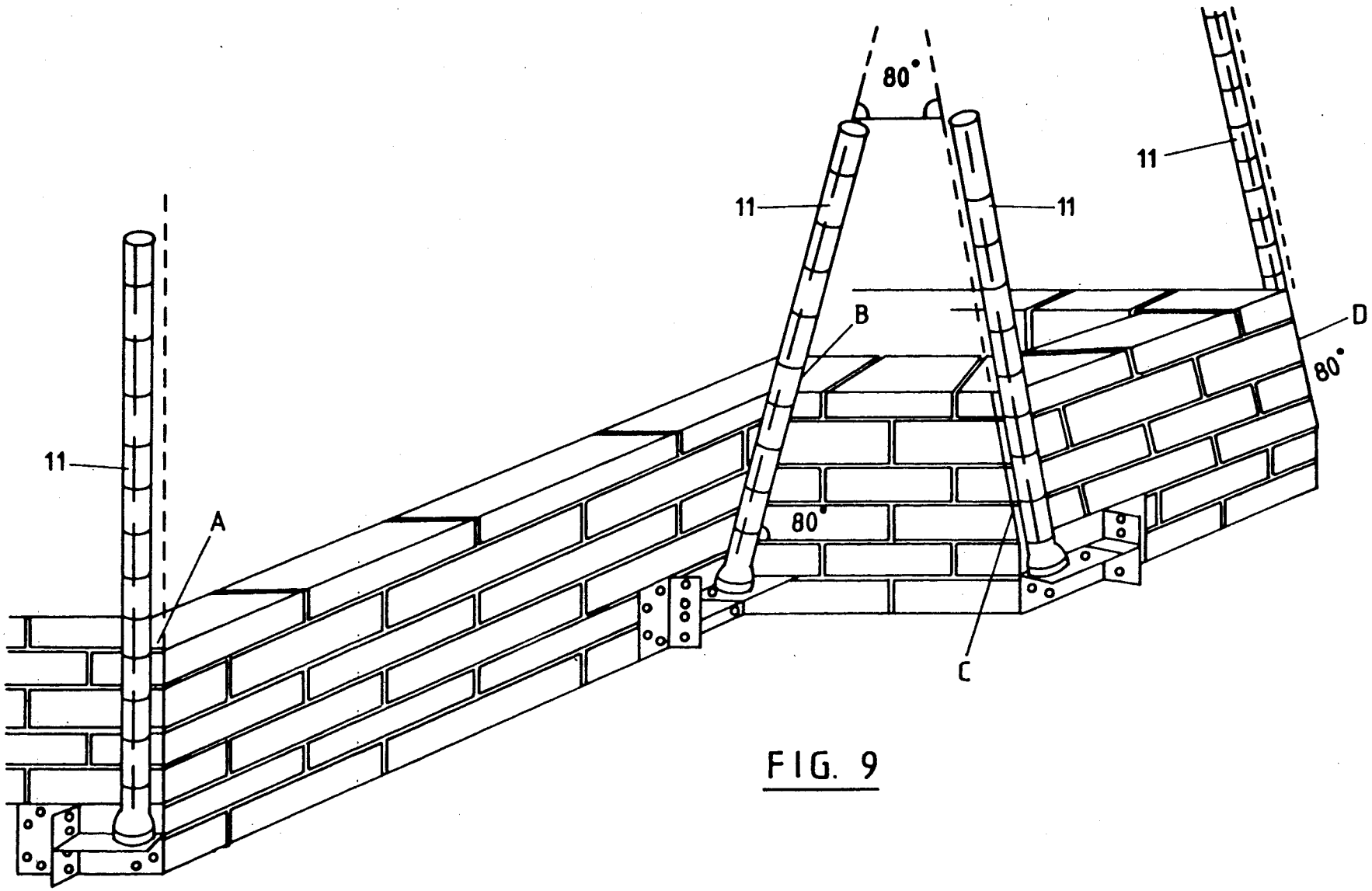
FIG. 9 shows the use of several profiling tools similar to the one shown in FIG. 7, when used for setting both external and internal corners and also non-vertical brickwork construction.

Referring to FIG. 9, four datum posts 11 are disposed along the length of a wall having both external corners A,C and D and an internal corner B. The brickwork is constructed between corners B and D at an angle of approximately 80 degrees to the horizontal.

Figure 10:
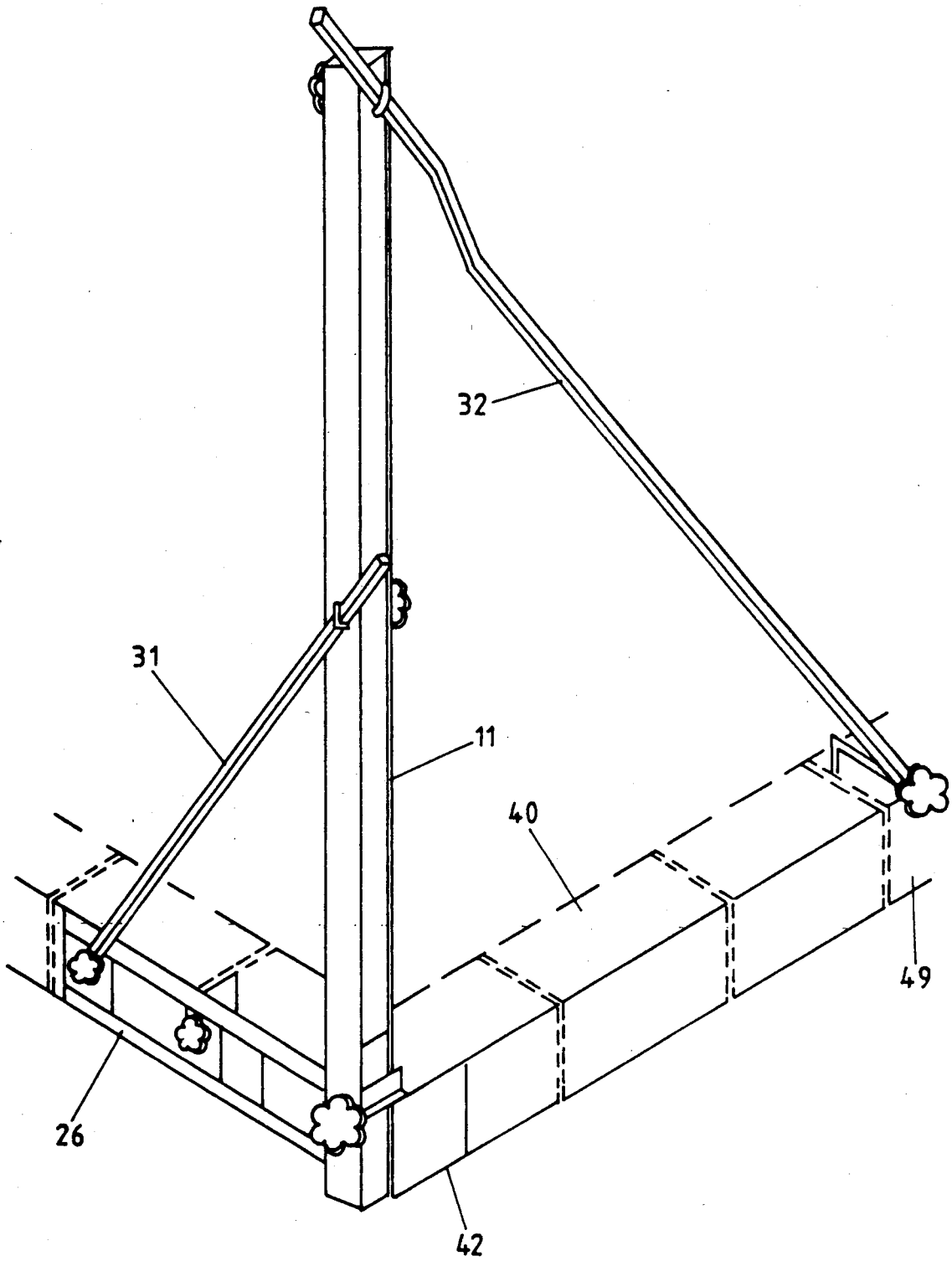
FIG. 10 shows a profiling tool broadly similar to that shown in FIG. 3, when used for setting an external perpendicular angle.

Referring to FIG. 10 (in which parts like those of FIGS. 3 to 6 are denoted by like reference numerals), there is shown a course of brickwork 40 having mounted thereto a plate 26, to which is mounted, adjacent the desired corner 42, a datum post 11. The arrangement illustrated is suitable for mounting both on right- and left-handed corners.

Datum post 11 is provided with a first short bracing strut 31 (which engages datum post 11 at an intermediate position and plate 26 remote from the datum post 11) and a long bracing strut 32 (which engages datum post 11 near the top thereof and a further plate 49 remote from the datum post). One end 49 of strut 31 may slide relative to the plate 26 to enable the angle set by the datum post to be adjusted.

Figure 11:
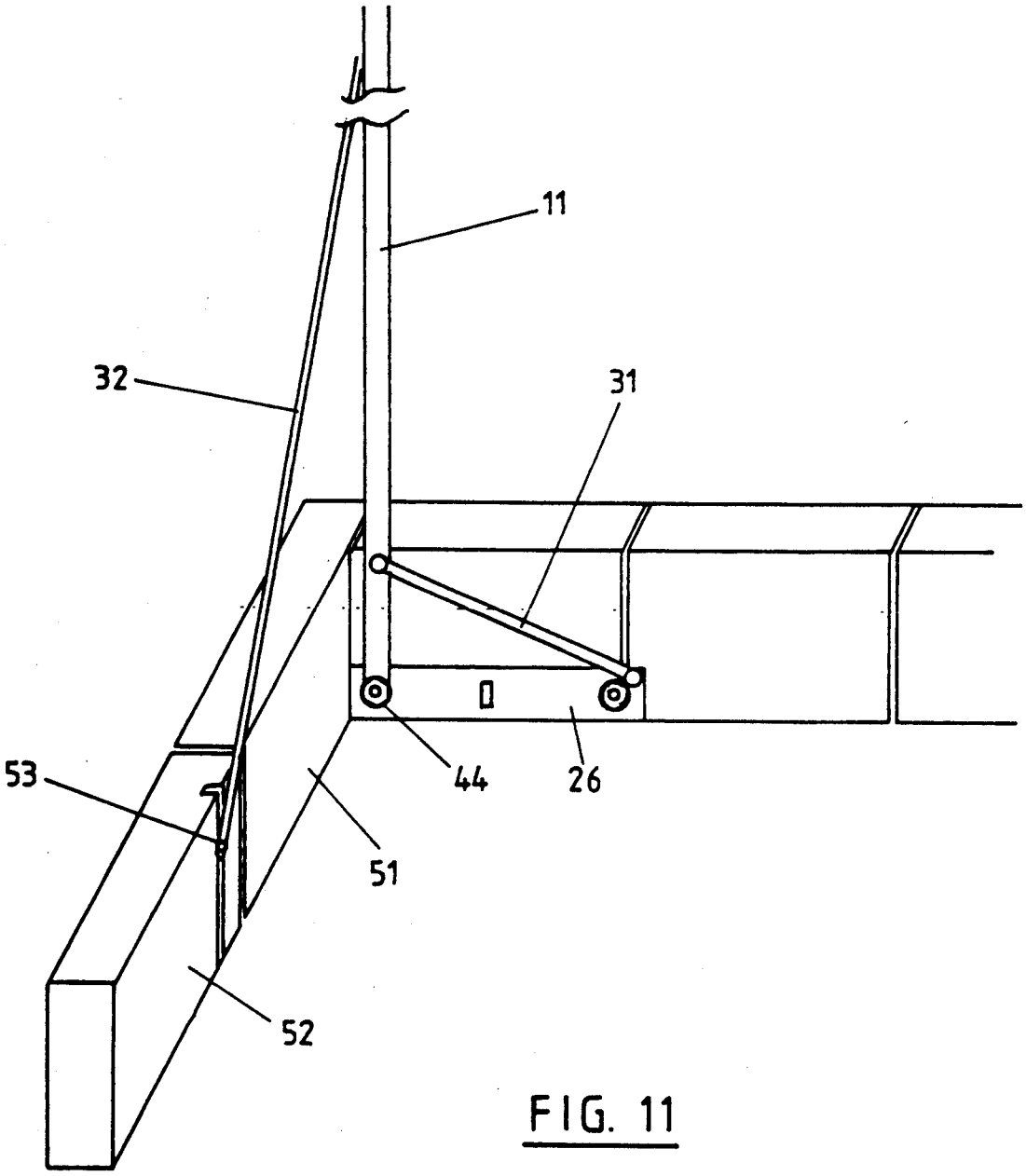
FIG. 11 shows a tool similar to that shown in FIG. 3, when used for setting an internal perpendicular angle in blockwork.

Referring to FIG. 11, in which parts like to those in FIG. 10 are denoted by like reference numerals, datum post 11 is pivotally mounted to plate 26 by means of knurled knob 44. Plate 26 is secured to a horizontal course of blocks 51, and the angle to be set is an internal perpendicular angle. Long bracing strut 32 is located on a desired block 52 by means of a fork member 53 which engages respectively upper and lower edges of block 52.

Profiling tools such as those illustrated in FIGS. 10 and 11 can be used to set straight runs of brickwork, as well as both internal and external corners.

Figure 12:
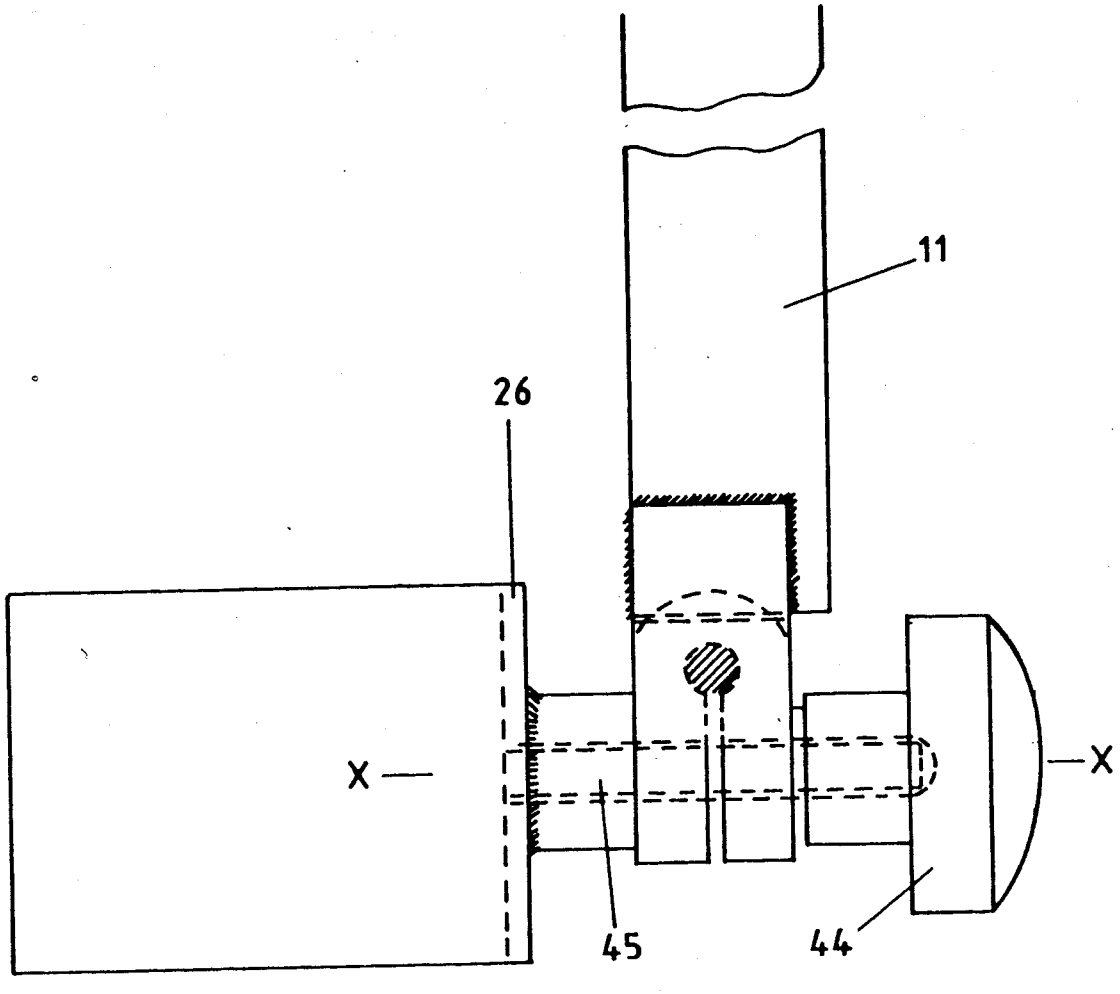
FIG. 12 shows in more detail a pivotal connection suitable for use in the profiling tool shown in FIG. 11.
Figure 12:
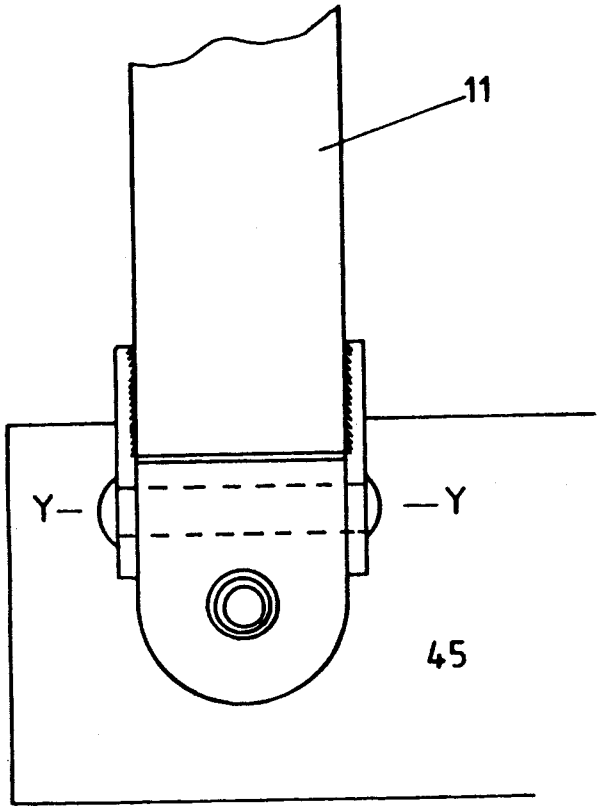

Referring to FIG. 12, knob 44 has a cylindrical shaft 45 which fits snugly and rotatably in cylindrical aperture 46 in datum post 11; shaft 45 is itself secured to plate 26. By the use of a pivotal connection such as that illustrated in FIG. 12, the datum post may be rotated or pivoted about two axes X—X and Y—Y; in the embodiment illustrated the datum post may be rotated through 360 degrees about axis X—X.

Figure 13:
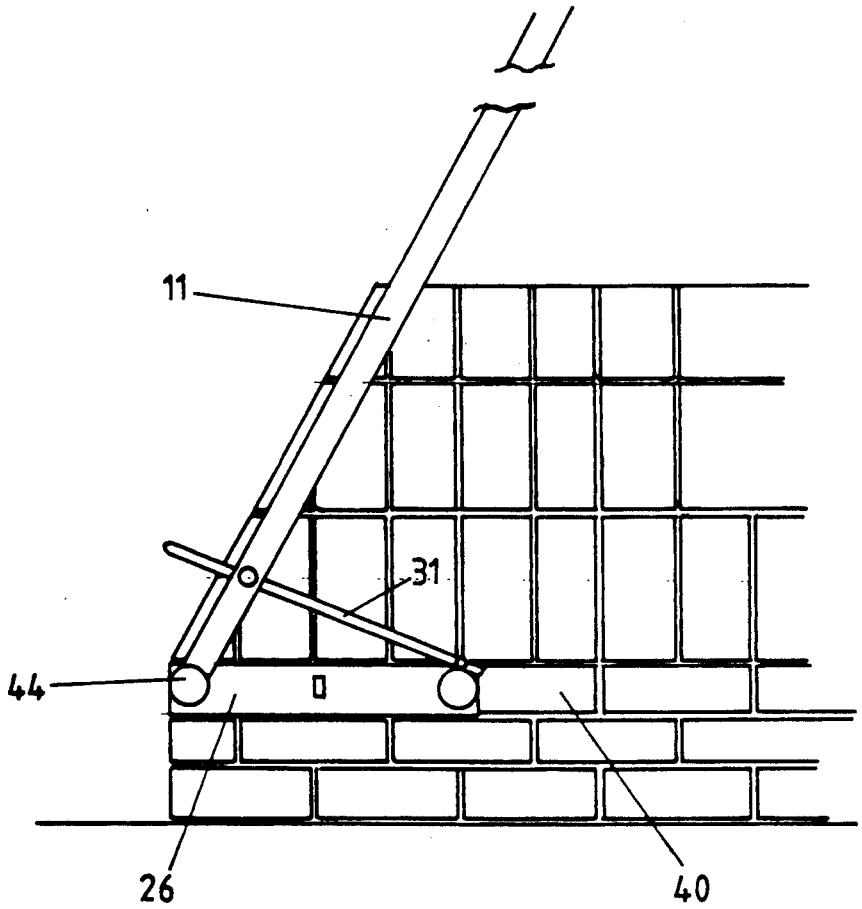
FIG. 13 shows an embodiment of profiling tool according to the invention, provided with a pivotal connection of the kind illustrated in FIG. 12, when used for setting brickwork at an angle of about 60° to the horizontal.
Figure 14:
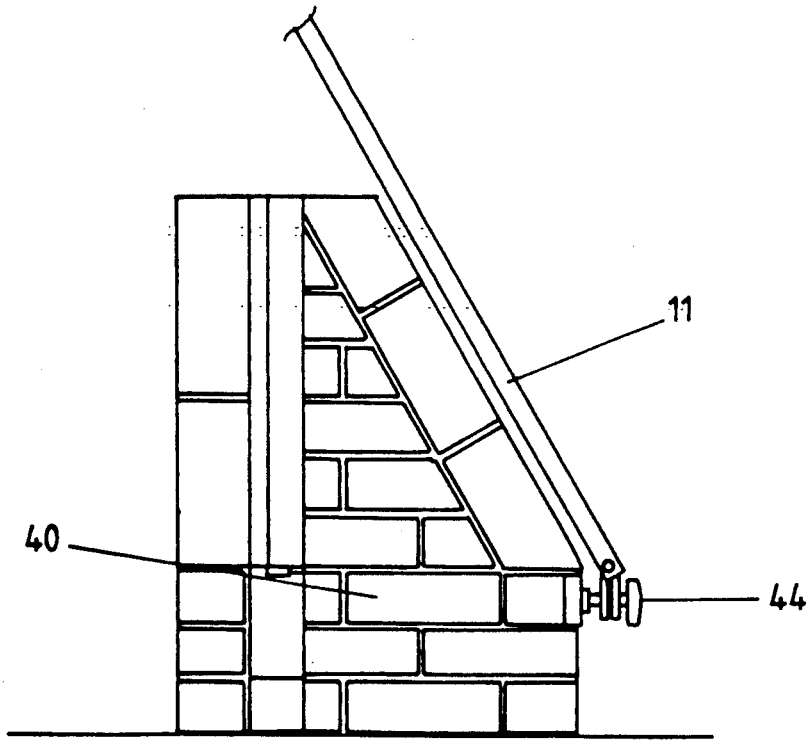
FIG. 14 is a side elevation of the arrangement of FIG. 13.

Such rotation is illustrated in FIGS. 13 and 14, in which parts like those in FIG. 11 are denoted by like reference numerals. In the illustrated arrangement, the datum post 11 is braced by short strut 31 such that the datum post is at an angle of about 60° to the horizontal.

Figure 15:
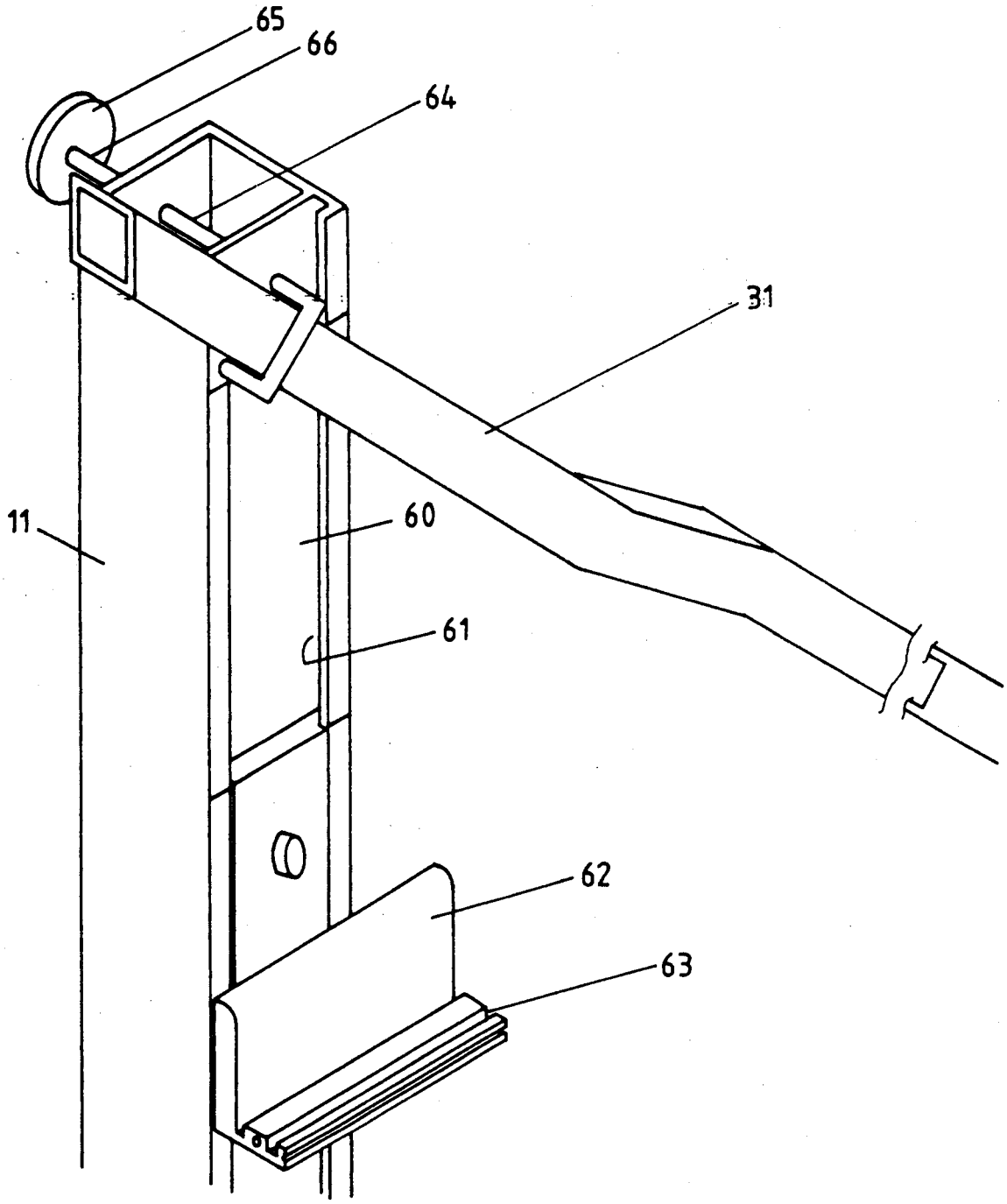
FIG. 15 shows an arrangement in which a horizontal line holder is slidably mounted within the datum post.

Referring to FIG. 15, the datum post 11 is of generally tubular construction; in an outer wall 60 is provided a channel construction 61 in which a horizontal line holder 62 is slidably disposed. The line holder is provided with a recess 63 in an upper face thereof for receiving a horizontal line. Strut 31 is secured to post 11 by means of a hook bolt 64 which passes transversely through the post 11; the hook bolt has a threaded knob 65 connected to the free end 66 thereof.

I claim:

1. A building profiling tool, which comprises:

a first plate member adapted to be located alongside a body of brickwork comprising at least a first course of brickwork comprising a plurality of bricks having a predetermined orientation relative to the horizontal;

means for securing said plate member to and alongside said first course of brickwork, said means comprising engagement means provided on said plate member for engaging a pair of upright sidewalls of said bricks in said first course of brickwork;

a datum post for defining a corner of said body of brickwork;

means for locating a further course of brickwork to be laid over said first course of brickwork;

means for providing a pivotal connection between said datum post and said plate member such that said plate member extends from said pivotal connection alongside said first course of brickwork; and means for setting said datum post at an angle to the horizontal such that when said further course of brickwork is laid to said locating means, said further course of brickwork is at a preset angle to said predetermined orientation.

2. A building profiling tool according to claim 1, wherein said at least one bracing element is secured both to said first plate member and to said datum post.

3. A building profiling tool according to claim 1, wherein said at least one said bracing element is arranged to be secured at one end to said datum post in a range of longitudinally spaced positions.

4. A building profiling tool according to claim 1, wherein a line holder for indicating a horizontal line is slidably mounted on said at least one bracing element.

5. A building profiling tool according to claim 1, wherein said pivotal connection is such that the datum post may rotate through 360 degrees about at least one axis.

6. A building profiling tool according to claim 1, wherein said pivotal connection permits pivotting of said datum post about two mutually perpendicular axes.

7. A building profiling tool according to claim 1, wherein said engagement means comprises a first clamp member, a second clamp member slidably retained on said plate member, and means for rigidly securing said clamp members at a fixed separation corresponding to the spacing between said opposed upright sidewalls.

8. A building profiling tool according to claim 1, which further comprises a horizontal line holder slidably mounted within said datum post.

9. A building profiling tool according to claim 1 wherein said means for setting said datum post at an angle to the horizontal comprises at least one bracing element secured to said datum post.

10. A building profiling tool according to claim 9 wherein said at least one bracing element is further secured to a second plate member remote from said first plate member.

11. A building profiling tool, which comprises:

a first plate member capable of being secured to a body of brickwork comprising at least a first course of brickwork having a predetermined orientation relative to the horizontal;

a datum post for defining a corner of said body of brickwork;

means for locating a further course of brickwork to be laid over said first course of brickwork;

means for providing a pivotal connection between said datum post and said plate member such that said plate member can extend from said pivotal connection alongside said first course of brickwork; and means for securing said plate member to opposed upright sidewalls of bricks in said first course, said securing means comprising a first clamp member, and a second clamp member slidably retained on said plate member, and means for rigidly securing said clamp members at a fixed separation corresponding to the spacing between opposed upright sidewalls of bricks in said first course of brickwork.

12. A building profiling tool according to claim 11, further comprising means for setting said datum post at an angle to the horizontal comprising at least one bracing element securing said datum post.

13. A building profiling tool according to claim 12, wherein said at least one bracing element is secured both to said first plate member and to said datum post.

14. A building profiling tool according to claim 12, wherein said at least one said bracing element is arranged to be secured at one end to said datum post in a range of longitudinally spaced positions.

15. A building profiling tool according to claim 12, wherein a line holder for indicating a horizontal line is slidably mounted on at least one of said bracing elements.

16. A building profiling tool according to claim 11, wherein said pivotal connection is such that said datum post may rotate through 360 degrees about at least one axis.

17. A building profiling tool according to claim 16, wherein said pivotal connection is adapted to permit pivotting of said datum post about two mutually perpendicular axes.

18. A building profiling tool according to claim 11, further comprising a horizontal line holder slidably mounted within said datum post.

19. A building profiling tool which comprises:

a first plate member adapted to be located alongside a body of brickwork having a facing with a predetermined orientation relative to the horizontal;

means for securing said plate member to and alongside said facing, said means comprising engagement means provided on said plate member for engaging a pair of opposed walls of said bricks in said body of brickwork;

a datum post for defining a corner of said body of brickwork;

means for locating a further bricks to be laid over said body of brickwork;

means for providing a pivotal connection between said datum post and said plate member such that said plate member extends from said pivotal connection alongside said facing; and means for setting said datum post at an angle to the horizontal such that when said further bricks are laid to said locating means, said further bricks have a facing at a preset angle to said predetermined orientation.

20. A building profiling tool according to claim 19 wherein said means for setting said datum post at an angle to the horizontal comprises at least one bracing element secured to said datum post.

21. A building profiling tool according to claim 20 wherein said at least one bracing element is further secured to a second plate member remote from said first plate member.

22. A building profiling tool according to claim 20 wherein said at least one bracing element is secured both to said plate member and to said datum post.

23. A building profiling tool according to claim 20 wherein said at least one bracing element is arranged to be secured at one end to said datum post in a range of longitudinally spaced positions.

24. A building profiling tool according to claim 20 wherein a line holder for indicating a horizontal line is slidably mounted on said at least one bracing element.

25. A building profiling tool according to claim 19 wherein said pivotal connection is such that the datum post may rotate through 360° about at least one axis.

26. A building profiling tool according to claim 19 wherein said pivotal connection permits pivoting of said datum post about two mutually perpendicular axes.

27. A building profiling tool according to claim 19 wherein said engagement means comprises a first clamp member, a second clamp member slidably retained on said plate member, a means for rigidly securing said clamp members at a fixed separation corresponding to the spacing between said opposed upright sidewalls.

28. A building profiling tool according to claim 19 which further comprises a horizontal line holder slidably mounted within said datum post.

* * * * *